US011821331B2

(12) United States Patent
Senoo et al.

(10) Patent No.: US 11,821,331 B2
(45) Date of Patent: Nov. 21, 2023

(54) STEAM TURBINE, AND BLADE

(71) Applicant: MITSUBISHI HEAVY INDUSTRIES, LTD., Tokyo (JP)

(72) Inventors: Shigeki Senoo, Tokyo (JP); Soichiro Tabata, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/903,451

(22) Filed: Sep. 6, 2022

(65) Prior Publication Data

US 2023/0003143 A1 Jan. 5, 2023

Related U.S. Application Data

(63) Continuation of application No. PCT/JP2021/013554, filed on Mar. 30, 2021.

(30) Foreign Application Priority Data

Mar. 31, 2020 (JP) ..... 2020-065282

(51) Int. Cl.
*F01D 25/32* (2006.01)
*F01D 5/14* (2006.01)
(Continued)

(52) U.S. Cl.
CPC ..... *F01D 25/32* (2013.01); *F01D 5/147* (2013.01); *F01D 9/041* (2013.01); *F01D 25/24* (2013.01); *F05D 2220/31* (2013.01)

(58) Field of Classification Search
CPC ..... F01D 5/186; F01D 25/32; F05D 2250/11; F05D 2250/294; F05D 2300/512
See application file for complete search history.

(56) References Cited

U.S. PATENT DOCUMENTS 1,862,827 A 6/1932 Parsons et al.
9,827,735 B2 * 11/2017 Schmidt ..... F01D 5/288
(Continued)

FOREIGN PATENT DOCUMENTS

DE 102009003898 A1 * 7/2010 ..... C23C 16/00
JP 64-080705 3/1989
(Continued)

OTHER PUBLICATIONS

International Search Report dated May 25, 2021 in International Application No. PCT/JP2021/013554, with English translation.
(Continued)

*Primary Examiner* — Courtney D Heinle
*Assistant Examiner* — Danielle M. Christensen
(74) *Attorney, Agent, or Firm* — Wenderoth, Lind & Ponack, L.L.P.

(57) ABSTRACT

This steam turbine comprises: a rotating shaft that extends along an axis; a plurality of rotor blades that are arranged in the circumferential direction and that extend in a radial direction from the outer circumferential surface of the rotating shaft; a casing body that covers the rotating shaft and the rotor blades from the outer circumference side; and a plurality of stationary blades that extend in the radial direction from a position on the inner circumferential surface of the casing body on the upstream side of the rotor blades and that are arranged in the circumferential direction. A plurality of microgrooves that extend in the steam flow direction are formed on the surface of the rotor blades and/or the stationary blades.

6 Claims, 3 Drawing Sheets

(51) Int. Cl.
*F01D 9/04* (2006.01)
*F01D 25/24* (2006.01)

(56) References Cited

U.S. PATENT DOCUMENTS

| | | | | |
|---|---|---|---|---|
| 10,107,302 | B2 * | 10/2018 | Berschback | F02C 3/04 |
| 2013/0032316 | A1 | 2/2013 | Dhiman et al. | |
| 2017/0122115 | A1 | 5/2017 | Fandrei, II | |
| 2018/0283180 | A1 | 10/2018 | Jain et al. | |

FOREIGN PATENT DOCUMENTS

| | | | |
|---|---|---|---|
| JP | 2012-202314 | | 10/2012 |
| JP | 2014-040803 | | 3/2014 |
| JP | 2014-077397 | | 5/2014 |
| JP | 2014-095309 | | 5/2014 |
| JP | 2014-531989 | | 12/2014 |
| JP | 5703082 | | 4/2015 |
| JP | 2016166569 | A * | 9/2016 |
| JP | 2017-096261 | | 6/2017 |

OTHER PUBLICATIONS

Written Opinion of the International Searching Authority dated May 25, 2021 in International Application No. PCT/JP2021/013554, with English translation.

* cited by examiner

STEAM TURBINE, AND BLADE

This application claims priority of Japanese Patent Application No. 2020-065282 filed in Japan on Mar. 31, 2020.

Priority is claimed on Japanese Patent Application No. 2020-065282, filed Mar. 31, 2020, and this application is a continuation application based on a PCT Patent Application No. PCT/JP2021/013554. The content of the PCT Application is incorporated herein by reference.

TECHNICAL FIELD

The present disclosure relates to a steam turbine and a blade.

BACKGROUND ART

A steam turbine includes a shaft that can rotate around a rotation axis, a plurality of turbine rotor blade stages that are arranged at intervals in a rotation axis direction on an outer peripheral surface of the shaft, a casing that covers the shaft and the turbine rotor blade stage from an outer peripheral side, and a plurality of turbine stator blade stages that are alternately arranged with turbine rotor blade stages on an inner peripheral surface of the casing. An intake port through which steam is taken in from the outside is formed on an upstream side of the casing, and an exhaust port is formed on a downstream side thereof. After a flow direction and a velocity of high-temperature and high-pressure steam taken in from the intake port are adjusted at the turbine stator blade stage, the steam is converted into a rotational force of the shaft at the turbine rotor blade stage.

The steam passing through the turbine loses energy from the upstream side to the downstream side, and the temperature (and pressure) thereof decreases. Therefore, in the turbine stator blade stage on the most downstream side, a portion of steam is condensed and exists in an air flow as fine water droplets, and a portion of the water droplets adheres to the surface of the turbine stator blade. These water droplets quickly grow on a blade surface to form a liquid film. The liquid film is constantly exposed to a high-speed steam flow around the liquid film, but when the liquid film grows further and becomes thicker, a portion of the liquid film is torn by the steam flow and scattered in the form of coarse droplets. The scattered droplets flow to the downstream side while gradually accelerating due to the steam flow. As a size of the droplet increases, a mass increases. Accordingly, it is difficult for the steam flow to accelerate to a steam velocity, and mainstream steam cannot pass between the turbine rotor blades and collides with the turbine rotor blades. Since a peripheral speed of the turbine rotor blade may exceed a speed of sound, when the scattered droplets collide with the turbine rotor blade, the droplets may erode the surface and generate erosion. In addition, the collision of droplets may hinder a rotation of the turbine rotor blade, resulting in braking loss.

Various techniques have been proposed so far in order to prevent the adhesion and the growth of such droplets. For example, PTL 1 below describes a technique for removing moisture generated on a surface of a turbine nozzle (turbine stator blade) by heating the surface with an electric heating unit. PTL 1 also describes a technique for optimizing an amount of heating by the electric heating unit by measuring a thickness of a water film.

CITATION LIST

Patent Literature

[PTL 1] Japanese Patent No. 5703082

SUMMARY OF INVENTION

Technical Problem

However, a velocity of a fluid flowing between turbine stator blades is high enough to reach 200 to 400 m/s as an example. A thickness of a water film is about several hundred microns. Therefore, in the technique described in PTL 1, a large error may occur in measurement of the thickness of the water film, and as a result, moisture may not be properly removed by an electric heating unit.

The present disclosure has been made to solve the above problems, and an object of the present disclosure is to provide a steam turbine and blades having further improved performance.

Solution to Problem

In order to solve the above problems, according to an aspect of the present disclosure, there is provided a steam turbine including: a shaft that extends along a rotation axis; a plurality of rotor blades that extend in a radial direction from an outer peripheral surface of the shaft and that are arranged in a circumferential direction; a casing main body that covers the shaft and the rotor blade from an outer peripheral side; and a plurality of stator blades that extend in the radial direction from a position on an upstream side of the rotor blade on an inner peripheral surface of the casing main body and that are arranged in the circumferential direction, in which a plurality of water-repellent microgrooves extending in a steam flow direction are formed on a surface of at least one of the rotor blade and the stator blade.

Advantageous Effects of Invention

According to the present disclosure, it is possible to provide a steam turbine and a blade having further improved performance.

DESCRIPTION OF EMBODIMENTS (Configuration of Steam Turbine)

Figure 1:
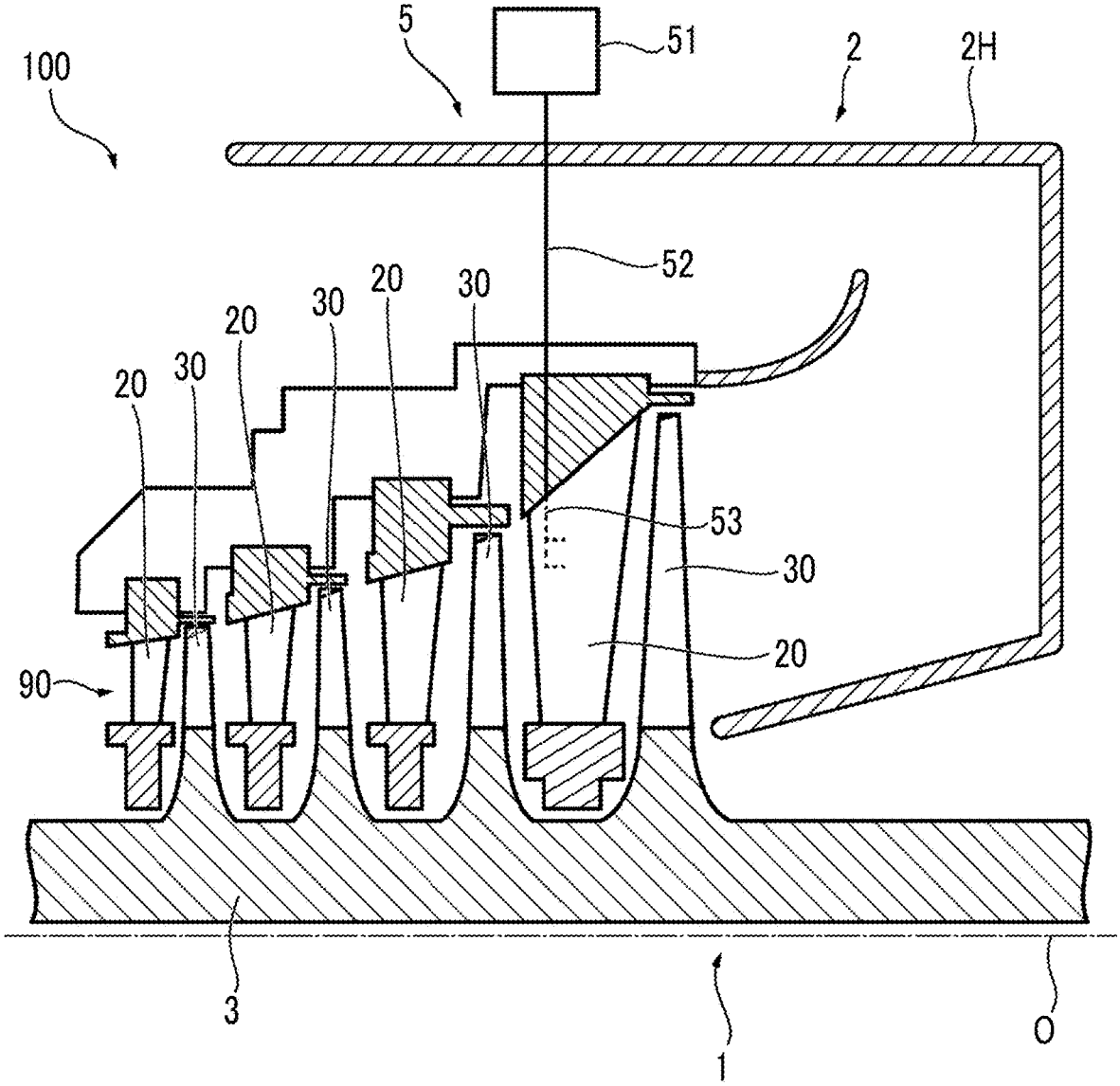
FIG. 1 is a diagram showing a configuration of a steam turbine according to one embodiment of the present disclosure.
Figure 2:
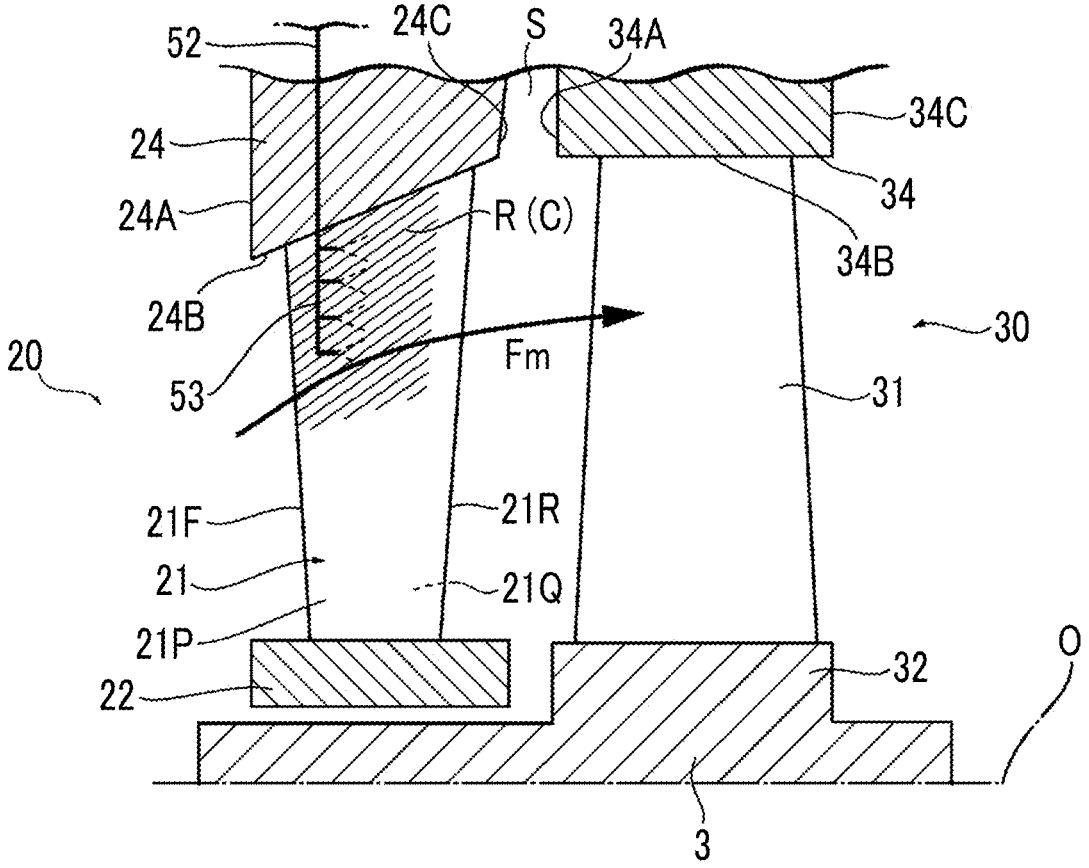
FIG. 2 is an enlarged view showing an internal configuration of the steam turbine according to one embodiment of the present disclosure.

Hereinafter, a steam turbine 100 according to one embodiment of the present disclosure will be described with reference to FIGS. 1 to 4. As shown in FIGS. 1 and 2, the steam turbine includes a steam turbine rotor 1 extending along a direction of a rotation axis O, a steam turbine casing 2 covering the steam turbine rotor 1 from an outer peripheral side, and a substance supply unit 5.

The steam turbine rotor 1 has a shaft 3 extending along the rotation axis O and a plurality of rotor blades 30 provided on an outer peripheral surface of the shaft 3. The plurality of rotor blades 30 are arranged at regular intervals in a circumferential direction of the shaft 3. Moreover, in the direction of the rotation axis O, a plurality of rows of rotor blades 30 (rotor blade stages) are arranged at regular intervals. As shown in FIG. 2, the rotor blade 30 has a rotor blade main body 31 (turbine rotor blade) and a rotor blade shroud 34. The rotor blade main body 31 protrudes radially outward from an outer peripheral surface of the steam turbine rotor 1. The rotor blade main body 31 has an airfoil-shaped cross section when viewed from a radial direction. The rotor blade shroud 34 is provided at a tip portion (radially outer end portion) of the rotor blade main body 31. A platform 32 is integrally provided with the shaft 3 at a base end portion (radially inner end portion) of the rotor blade main body 31.

As shown in FIG. 1, the steam turbine casing 2 includes a substantially tubular casing main body 2H (casing main body) that covers the steam turbine rotor 1 from the outer peripheral side, and a stator blade 20 provided on an inner peripheral surface of the casing main body 2H. A steam supply pipe (not shown) for taking in steam is provided on one side of the steam turbine casing 2 in the direction of the rotation axis O. A steam discharge pipe (not shown) for discharging steam is provided on the other side of the steam turbine casing 2 in the direction of the rotation axis O. Steam flows inside the steam turbine casing 2 from one side toward the other side in the direction of the rotation axis O. In the following description, a direction in which steam flows is simply referred to as a "flow direction". Further, a side where the steam flows is called an upstream side in the flow direction, and a side where the steam flows away is called a downstream side in the flow direction.

A plurality of rows of stator blades 20 are provided on an inner peripheral surface of the steam turbine casing 2. As shown in FIG. 2, the stator blade 20 has a stator blade main body 21 (turbine stator blade), a stator blade shroud 22, and an outer peripheral ring 24. The stator blade main body 21 is a blade-shaped member connected to the inner peripheral surface of the steam turbine casing 2 via the outer peripheral ring 24. Further, the stator blade shroud 22 is provided at a tip portion (radially inner end portion) of the stator blade main body 21. Similar to the rotor blade 30, a plurality of stator blades 20 are arranged on the inner peripheral surface along the circumferential direction and the direction of the rotation axis O. The rotor blades 30 are arranged so as to enter regions between the plurality of adjacent stator blades 20. That is, the stator blade 20 and the rotor blade 30 extend in a direction (radial direction with respect to the rotation axis O) intersecting the steam flow direction. In the following description, the stator blade 20 and the rotor blade 30 may be collectively referred to as a blade 90.

The steam is supplied to the inside of the steam turbine casing 2 via the steam supply pipe on the upstream side. While passing through the inside of the steam turbine casing 2, steam alternately passes through the stator blades 20 and the rotor blades 30. The stator blade 20 rectifies the flow of steam S, and the rectified mass of steam pushes the rotor blade 30 to give rotational force to the steam turbine rotor 1. The rotational force of the steam turbine rotor 1 is taken out from a shaft end 11 and is used to drive an external device (generator or the like). As the steam turbine rotor 1 rotates, steam is discharged toward a subsequent device (condenser or the like) through a steam discharge pipe 13 on the downstream side.

Although not shown in detail, the shaft 3 is rotatably supported inside the steam turbine casing 2 by a journal bearing and a thrust bearing.

(Configuration of Stator Blade Main Body)

Next, a configuration of the stator blade main body 21 will be described with reference to FIG. 2. The stator blade main body 21 extends in the radial direction (radial direction with respect to the rotation axis O), which is a direction intersecting the flow direction. A cross section of the stator blade main body 21 seen from the radial direction has an airfoil shape. More specifically, a leading edge 21F, which is an end edge on the upstream side in the flow direction, has a curved surface shape. A trailing edge 21R, which is an end edge on the downstream side, has a tapered shape because a dimension in the circumferential direction is gradually reduced when viewed from the radial direction. From the leading edge 21F to the trailing edge 21R, the stator blade main body 21 is gently curved from one side in the circumferential direction with respect to the rotation axis O toward the other side. Further, the dimension of the stator blade main body 21 in the direction of the rotation axis O decreases toward an inner side in the radial direction. Of a pair of surfaces of the stator blade main body 21 facing the circumferential direction, the surface facing the upstream side is a pressure surface 21P, and the surface facing the downstream side is a negative pressure surface 21Q.

Of the pressure surface 21P and the negative pressure surface 21Q, a plurality of microgrooves R are formed on at least the pressure surface 21P. The microgroove R is recessed inward from the surface of the stator blade main body 21. The microgrooves R extend in the steam flow direction Fm and are arranged in a direction intersecting the flow direction Fm. The "flow direction Fm" referred to here refers to the curved direction in which steam flows inside the steam turbine 100, and is different for each stage of the stator blade 20 and the rotor blade 30. It is desirable that such a "flow direction Fm" be measured and set based on, for example, numerical analysis or verification tests on an actual machine.

Figure 3:
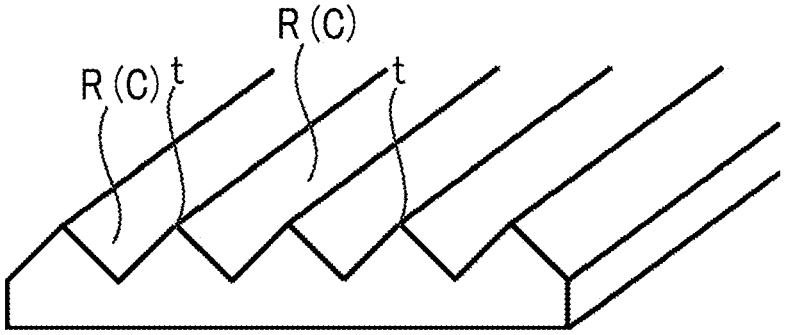
FIG. 3 is a perspective view showing a configuration of a microgroove according to one embodiment of the present disclosure.
Figure 4:
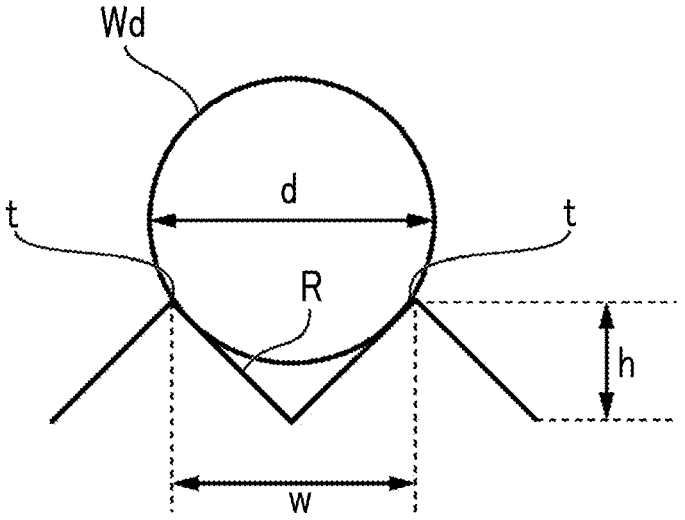
FIG. 4 is an explanatory diagram showing dimensions of the microgroove according to one embodiment of the present disclosure.

As shown in FIG. 3, in the present embodiment, the microgroove R has a triangular cross-sectional shape. Further, as shown in FIG. 4, when a cross-sectional shape of the microgroove R is a right-angled isosceles triangle, and a distance between tops t of the microgrooves R is w, the value of w is set to satisfy $1\ \mu m \leq w < 35\ \mu m$. Further, it is desirable that a value of a height h from a bottom portion to the top t of the microgroove R is $h=w/2$. By setting the height h to such a value, a size of a water droplet can be controlled. Further, during machining, a cutting edge of a tool easily reaches a bottom surface of the microgroove R, and thus, both machining accuracy and manufacturing ease can be achieved.

Further, as shown in FIG. 2, it is desirable that a region where the microgroove R is formed is a region from the outer peripheral side where erosion of the rotor blade 30 is particularly problematic, that is, the radially outer end portion of the stator blade main body 21 to ⅓ of the height of the stator blade. The microgroove R may be formed over the entire height of the stator blade.

It is desirable that the microgroove R as described above is formed by applying laser processing to the surface of a metallic material constituting the stator blade main body 21. Meanwhile, as long as a heat resistance requirement is satisfied, it is possible to adopt a configuration in which a film-like sheet having the microgroove R formed in advance is attached to the stator blade main body 21. Due to the formation of such microgrooves R, the surface of the stator blade main body 21 has water repellency.

The outer peripheral ring 24 is attached to a radially outer end portion of the stator blade main body 21. The outer peripheral ring 24 has an annular shape centered on the rotation axis O. Of surfaces of the outer peripheral ring 24, the surface facing the upstream side is a ring upstream surface 24A, the surface facing the inner peripheral side is a ring inner peripheral surface 24B, and the surface facing the downstream side is a ring downstream surface 24C. The ring upstream surface 24A and the ring downstream surface 24C extend in the radial direction with respect to the rotation axis O. A radial dimension of the ring upstream surface 24A is larger than a radial dimension of the ring downstream surface 24C. As a result, as an example in the present embodiment, the ring inner peripheral surface 24B gradually expands toward the outside in the radial direction toward the downstream side. The outer peripheral ring 24 forms a portion of the steam turbine casing 2. That is, the ring inner peripheral surface 24B is a portion of the inner peripheral surface of the steam turbine casing 2.

The ring downstream surface 24C faces the rotor blade shroud 34 of the rotor blade 30 adjacent to the downstream side of the stator blade 20 with a gap S. Of surfaces of the rotor blade shroud 34, the surface facing the upstream side is a shroud upstream surface 34A, the surface facing the inner peripheral side is a shroud inner peripheral surface 34B, and the surface facing the downstream side is a shroud downstream surface 34C. That is, the above-mentioned ring downstream surface 24C faces the shroud upstream surface 34A with the gap S.

(Configuration of Substance Supply Unit)

Next, the configuration of the substance supply unit 5 will be described with reference to FIGS. 1 and 2. The substance supply unit 5 is provided to supply a film forming substance (FFS) so as to cover the above-described microgroove R. A film C having water repellency is formed on the surface of the microgroove R by the film forming substance.

As shown in FIG. 1, the substance supply unit 5 has a storage portion 51, a supply flow path 52, and a discharge unit 53. The storage portion 51 is a container for storing the film forming substance. The supply flow path 52 is a flow path formed inside the steam turbine casing 2, and the film forming substance guided from the storage portion 51 flows through the supply flow path 52. The supply flow path 52 extends in an annular shape centered on the rotation axis O. In the example of FIG. 1, the supply flow path 52 is formed only in the one-stage stator blade 20 (particularly, the final-stage stator blade 20). However, the supply flow path 52 may be provided corresponding to the stator blades 20 of all stages.

As shown in FIG. 2, an end portion of the supply flow path 52 penetrates the outer peripheral ring 24 in the radial direction and opens to the inner surface (ring inner peripheral surface 24B) in the radial direction. The discharge unit 53 extends radially inward from this opening, and thus, extends to the inside of the stator blade main body 21. The discharge unit 53 is a flow path that guides the film forming substance to the surface of the stator blade main body 21. The discharge unit 53 extends radially from a radially outer end portion of the stator blade main body 21 to a length of ⅓ of a blade height. It is also possible to adopt a configuration in which the supply flow path 52 extends over the entire area in a height direction of the blade.

The film forming substance pumped from the storage portion 51 by a pump or the like (not shown) is sprayed from an outlet E of the discharge unit 53 onto the pressure surface 21P and the negative pressure surface 21Q through the supply flow path 52. As a result, the film forming substance forms the water-repellent film C that covers at least the microgroove R. An amount of the film forming substance supplied is desirably 2 to several hundred ppm with respect to a flow rate of a water film formed by the condensation of steam on the pressure surface 21P or on the negative pressure surface 21Q.

(Film Forming Substance)

Specifically, as the film forming substance, a volatile amine compound (coating amine) having volatile properties, a surface-active action, and anticorrosion properties, and a volatile non-amine compound are preferably used. In forming the film C, instead of the configuration in which the film forming substance is normally supplied, a configuration in which a water-repellent coating is bonded on the pressure surface 21P or on the negative pressure surface 21Q can be adopted. In this case, the film C can be easily and inexpensively formed by only applying the water-repellent coating to the blade 90. This makes it possible to reduce manufacturing costs and man-hours.

(Action Effect)

According to the above configuration, the microgroove R is formed on the pressure surface 21P and on the negative pressure surface 21Q. As a result, water droplets condensed on the surface of the blade 90 are guided along the microgroove R toward the downstream side of the steam flow direction Fm. As a result, the probability of water droplets growing on the surface of the blade 90 can be reduced.

Further, since the microgroove R is covered with the film C, the water droplets do not grow in the microgroove R, and flow away as fine water droplets. As a result, generation of coarse water droplets can be suppressed, and the probability of erosion occurring in the other blades 90 on the downstream side can be reduced. Further, since a frictional resistance against the flow of steam is reduced, efficiency of the steam turbine 100 can be improved.

Further, according to the above configuration, since the microgroove R has a triangular cross section, a contact area between the microgroove R and the water droplet is reduced, and the water droplet can be smoothly guided. Further, since the microgroove R has a simple shape, a cost required for machining can be reduced.

Figure 5:
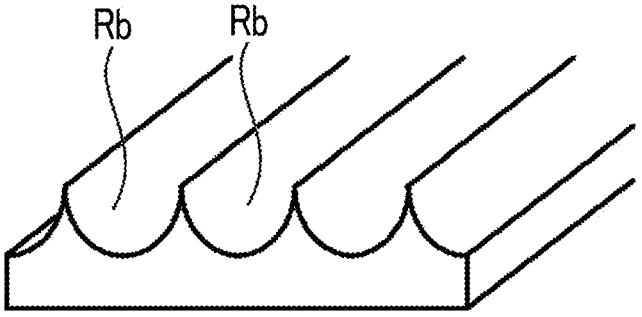
FIG. 5 is a cross-sectional view showing a modification example of the microgroove according to one embodiment of the present disclosure.

In addition, according to the above configuration, since the distance w between the tops t of the microgrooves R is less than 35 μm, as shown in FIG. 4, it is possible to prevent a water droplet Wd flowing along the microgrooves R from growing into a coarse water droplet having a diameter of 50 μm or more. Furthermore, the inventors have confirmed that a diameter d of the water droplet Wd can be limited to the same extent as the distance w when the microgroove has a groove shape in which a top is pointed as shown in FIG. 5. That is, depending on the shape of the groove, an allowable value of the distance w is 50 μm. This makes it possible to further reduce the probability of erosion occurring in the blade 90 on the downstream side. Further, since the distance w is 1 μm or more, it is possible to prevent accuracy required for machining the microgroove R from becoming excessively high and to ensure the ease of manufacturing.

Furthermore, according to the above configuration, the film forming substance (FFS) is directly supplied to the surface of the blade 90 through the discharge unit 53. As a result, the water-repellent film C is formed on the surface, and the adhesion probability of condensed water droplets can be reduced. Therefore, the generation of coarse water droplets caused by the growth of minute water droplets is suppressed, and the erosion caused by the collision of the coarse water droplets with the rotor blade 30 on the downstream side can be avoided. Further, since the film forming substance has a turbulent friction reducing effect (Toms effect), it is possible to improve a flow field of the fluid on the surface of the blade 90. Further, since the film forming substance forms the film C on the metal surface, an anticorrosion effect can be obtained. In addition, since the film forming substance can be normally supplied by the substance supply unit 5, it is possible to suppress the decrease in water repellency due to long-term use to a smaller extent as compared with the configuration in which the film C is formed by, for example, coating.

Other Embodiments

The embodiment of the present disclosure has been described above. It is possible to make various changes and modifications to the above configuration as long as it does not deviate from the gist of the present disclosure. For example, in the above embodiment, the configuration in which the microgroove R has a cross-sectional shape of a right-angled isosceles triangle has been described. However, the cross-sectional shape of the microgroove R is not limited to the above, and the shape shown in FIG. 5 or FIG. 6 can be adopted. As shown in these figures, the cross-sectional shape of the microgroove R is not limited to the right-angled isosceles triangle. In the example of FIG. 5, the microgroove Rb has a curved cross-sectional shape that is concave from the surface of the blade 90 and that is convex inwardly. According to this configuration, since an inclination near an apex is close to perpendicular to the surface of the blade 90, the diameter of the water droplet can be suppressed to be smaller than that in the case of a triangular groove. That is, in a case where the vicinity of the apex is sharpened as shown in FIG. 5, when the distance w of the microgroove Rb is less than 50 μm, the water droplet Wd flowing along the microgroove R can be prevented from growing into a coarse water droplet having a diameter of 50 μm or more. This makes it possible to further reduce the probability of erosion occurring in the blade 90 on the downstream side.

Figure 6:
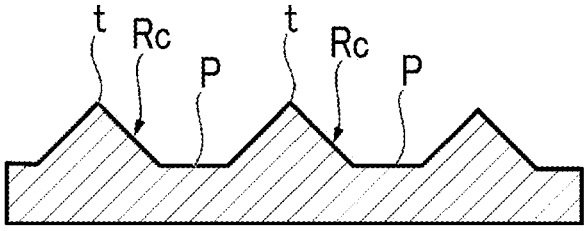
FIG. 6 is a cross-sectional view showing a further modification example of the microgroove according to one embodiment of the present disclosure.

Further, in the example of FIG. 6, a bottom surface P that spreads flat is formed between the microgrooves Rc. Even with such a configuration, the same action and effect as those described above can be obtained.

Further, a configuration is adopted in which the film C is formed on the surface of the rotor blade 30 in addition to the stator blade 20, and thus, the film C formed on the surface of the rotor blade 30 can improve anticorrosion performance of the rotor blade 30. In this case, it is conceivable that a flow path is formed inside the shaft 3 and a film forming substance is supplied from the flow path to the surface of the rotor blade 30, or that coating is applied to the surface of the rotor blade 30. Since the stator blade 20 and means for supplying the film forming substance can be shared, rust-inhibiting of the rotor blade 30 can be improved with a minimum configuration.

Further, a configuration in which the microgroove R is covered with the film forming substance supplied from the substance supply unit 5 described in the above-described embodiment and a configuration in which the surface of the blade 90 is coated in advance as the film C can be combined.

Since the above-mentioned microgroove R exhibits water repellency due to its shape itself, it is possible to adopt a configuration in which the film C is not provided and only the microgroove R exhibits water repellency against water droplets.

[Additional Notes]

The steam turbine 100 described in each embodiment is understood as follows, for example.

(1) According to a first aspect, there is provided a steam turbine 100 including: a shaft 3 that extends along a rotation axis O; a plurality of rotor blades 30 that extend in a radial direction from an outer peripheral surface of the shaft 3 and that are arranged in a circumferential direction; a casing main body (casing main body 2H) that covers the shaft 3 and the rotor blade 30 from an outer peripheral side; and a plurality of stator blades 20 that extend in the radial direction from a position on an upstream side of the rotor blade 30 on an inner peripheral surface of the casing main body and that are arranged in the circumferential direction, in which a plurality of water-repellent microgrooves R extending in a steam flow direction Fm are formed on a surface of at least one of the rotor blade 30 and the stator blade 20.

According to the above configuration, the microgroove R is formed on the surface of at least one of the rotor blade 30 and the stator blade 20. As a result, water droplets condensed on the surface of the blade 90 flow away along the microgroove R toward the downstream side in the steam flow direction Fm. As a result, the probability of water droplets growing on the surface of the blade 90 can be reduced.

(2) In the steam turbine 100 according to a second aspect, the microgroove R may have a triangular cross-sectional shape recessed from the surface.

According to the above configuration, a contact area between the microgroove R and the water droplet is reduced, and the water droplet can be smoothly guided. Further, since the microgroove R has a simple shape, a cost required for machining can be reduced.

(3) In the steam turbine 100 according to a third aspect, the microgroove Rb may have a curved cross-sectional shape that is concave from the surface and that is convex inwardly.

According to the above configuration, since the microgroove Rb has a curved cross section, the contact area between the microgroove Rb and the water droplet is further reduced, and the water droplet can be guided more smoothly.

(4) In the steam turbine 100 according to a fourth aspect, when where w is a distance between tops t of the microgrooves R, 1 μm≤w<35 μm may be set.

According to the above configuration, since the distance w between the tops t of the microgrooves R is less than 35 μm, it is possible to prevent water droplets Wd flowing along the microgrooves R from growing into coarse water droplets having a diameter of 50 μm or more. This makes it possible to further reduce the probability of erosion occurring in the blade 90 on the downstream side.

(5) In the steam turbine 100 according to a fifth aspect, when w is a distance between tops t of the microgrooves R, 1 μm≤w<50 μm may be set.

According to the above configuration, since the distance w between the tops t of the microgrooves R is less than 50 μm, it is possible to prevent the water droplets Wd flowing along the microgrooves R from growing into coarse water droplets having a diameter of 50 μm or more. This makes it possible to further reduce the probability of erosion occurring in the blade 90 on the downstream side.

(6) The steam turbine 100 according to a sixth aspect may further include a water-repellent film C that covers the microgroove R.

According to the above configuration, since the microgroove R is covered with the film C, the water droplets do not grow in the microgroove R, and flow away as fine water droplets. As a result, generation of coarse water droplets can be suppressed, and the probability of erosion occurring in the other blades 90 on the downstream side can be reduced. Further, since a frictional resistance against the flow of steam is reduced, efficiency of the steam turbine 100 can be improved.

(7) The steam turbine 100 according to a seventh aspect may further include a substance supply unit 5 that supplies, to the surface, a film forming substance that exhibits water repellency to water droplets condensed on the surface, in which the substance supply unit 5 may include a storage portion 51 that stores the film forming substance, a supply flow path 52 which is formed inside the casing main body and through which the film forming substance guided from the storage portion 51 flows, and a discharge unit 53 that is formed inside at least one of the rotor blade 30 and the stator blade 20 and that guides the film forming substance to the surface, and the film C may be formed of the film forming substance.

According to the above configuration, the film forming substance (FFS) is directly supplied to the surface of at least one of the rotor blade 30 and the stator blade 20 through the discharge unit 53. As a result, the water-repellent film C is formed on the surface, and the adhesion probability of condensed water droplets can be reduced. Therefore, the generation of coarse water droplets caused by the growth of minute water droplets is suppressed, and the erosion caused by the collision of the coarse water droplets with the rotor blade 30 on the downstream side can be avoided. Further, since the film forming substance has a turbulent friction reducing effect (Toms effect), it is also possible to improve a flow field of fluid on the surface of at least one of the rotor blade 30 and the stator blade 20. Further, since the film forming substance forms the film C on the metal surface, an anticorrosion effect can be obtained. In addition, since the film forming substance can be normally supplied by the substance supply unit 5, it is possible to avoid a decrease in water repellency due to long-term use.

(8) In the steam turbine 100 according to an eighth aspect, the film C may be a coating formed of a water-repellent material and bonded to the surface.

According to the above configuration, the film C can be easily and inexpensively formed by only applying a water-repellent coating to the blade 90. This makes it possible to reduce manufacturing costs and man-hours.

(9) According to a ninth aspect, there is provided a blade 90 extending in a steam flow direction Fm and including a water-repellent microgroove R formed on a surface of blade 90.

According to the above configuration, the microgroove R is formed on a surface of a main body of the blade 90. As a result, water droplets condensed on the surface of the blade 90 flow away along the microgroove R toward the downstream side in the steam flow direction Fm. As a result, the probability of water droplets growing on the surface of the blade 90 can be reduced.

(10) In the blade 90 according to a tenth aspect, the microgroove R may have a triangular cross-sectional shape recessed from the surface.

According to the above configuration, a contact area between the microgroove R and the water droplet is reduced, and the water droplet can be smoothly guided. Further, since the microgroove R has a simple shape, a cost required for machining can be reduced.

(11) In the blade 90 according to an eleventh aspect, the microgroove Rb may have a curved cross-sectional shape that is concave from the surface and that is convex inwardly.

According to the above configuration, since the microgroove Rb has a curved cross section, the contact area between the microgroove Rb and the water droplet is further reduced, and the water droplet can be guided more smoothly.

(12) In the blade 90 according to a twelfth aspect, when w is a distance between tops t of the microgrooves R, 1 μm≤w<35 μm may be set.

According to the above configuration, since the distance w between the tops t of the microgrooves R is less than 35 μm, it is possible to prevent water droplets Wd flowing along the microgrooves R from growing into coarse water droplets having a diameter of 50 μm or more. This makes it possible to further reduce the probability of erosion occurring in the blade 90 on the downstream side.

(13) In the blade 90 according to a thirteenth aspect, when w is a distance between tops t of the microgrooves R, 1 μm≤w<50 μm may be set.

According to the above configuration, since the distance w between the tops t of the microgrooves R is less than 50 μm, it is possible to prevent the water droplets Wd flowing along the microgrooves R from growing into coarse water droplets having a diameter of 50 μm or more. This makes it possible to further reduce the probability of erosion occurring in the blade 90 on the downstream side.

(14) The blade 90 according to a fourteenth aspect may further include a water-repellent film C that covers the microgroove R.

According to the above configuration, since the microgroove R is covered with the film C, the water droplets do not grow in the microgroove R, and flow away as fine water droplets. As a result, generation of coarse water droplets can be suppressed, and the probability of erosion occurring in the other blades 90 on the downstream side can be reduced. Further, since a frictional resistance against the flow of steam is reduced, efficiency of the steam turbine 100 can be improved.

INDUSTRIAL APPLICABILITY

According to the present disclosure, it is possible to provide a steam turbine and a blade having further improved performance.

REFERENCE SIGNS LIST

100: Steam turbine
1: Steam turbine rotor
2: Steam turbine casing
2H: Casing main body
3: Shaft
5: Substance supply unit
20: Stator blade
21: Stator blade main body
21F: Leading edge
21P: Pressure surface
21Q: Negative pressure surface

21R: Trailing edge
22: Stator blade shroud
24: Outer peripheral ring
24A: Ring upstream surface
24B: Ring inner peripheral surface
24C: Ring downstream surface
30: Rotor blade
31: Rotor blade main body
32: Platform
34: Rotor blade shroud
34A: Shroud upstream surface
34B: Shroud inner peripheral surface
34C: Shroud downstream surface
51: Storage portion
52: Supply flow path
53 Discharge unit
90: Blade
C: Film
Fm: Steam flow direction
O: Rotation axis
P: Bottom surface
R, Rb, Rc: Microgroove
t: Top

The invention claimed is:

1. A steam turbine comprising:

a rotating shaft that extends along an axis;

a plurality of rotor blades that extend in a radial direction from an outer peripheral surface of the rotating shaft and that are arranged in a circumferential direction;

a casing main body that covers the rotating shaft and the rotor blade from an outer peripheral side; and a plurality of stator blades that extend in the radial direction from a position on an upstream side of the rotor blades on an inner peripheral surface of the casing main body and that are arranged in the circumferential direction, wherein a plurality of water-repellent microgrooves extending in a steam flow direction are formed on a surface of at least one of the rotor blades or at least one of the stator blades, the steam turbine further includes:

a water-repellent film that covers the microgrooves; and a substance supply unit configured to supply, to the surface, a film forming substance that exhibits water repellency to water droplets condensed on the surface, wherein the substance supply unit includes:

a storage portion for storing the film forming substance;

a supply flow path which is formed inside the casing main body and through which the film forming substance guided from the storage portion flows; and a discharge unit for guiding the film forming substance to the surface, wherein the water-repellent film is formed of the film forming substance.

2. The steam turbine according to claim 1, wherein each of the microgrooves has a triangular cross-sectional shape recessed from the surface.

3. The steam turbine according to claim 2, wherein when where w is a distance between tops of the microgrooves, 1 μm≤w<35 μm.

4. The steam turbine according to claim 1, wherein each of the microgrooves has a curved cross-sectional shape that is concave from the surface and that is convex inwardly.

5. The steam turbine according to claim 1, wherein when w is a distance between tops of the microgrooves, 1 μm≤w<50 μm.

6. The steam turbine according to claim 1, wherein the discharge unit is formed inside the at least one rotor blade or the at least one stator blade.

* * * * *